US005792282A

United States Patent [19]

Tahara et al.

[11] Patent Number: 5,792,282

[45] Date of Patent: Aug. 11, 1998

[54] METHOD OF CARBURIZING AUSTENITIC STAINLESS STEEL AND AUSTENITIC STAINLESS STEEL PRODUCTS OBTAINED THEREBY

[75] Inventors: Masaaki Tahara, Takatsuki; Haruo Senbokuya, Tondabayashi; Kenzo Kitano, Kawachinagano; Tadashi Hayashida, Nishinomiya, all of Japan

[73] Assignee: Daido Hoxan, Inc., Sapporo, Japan

[21] Appl. No.: 645,264

[22] Filed: May 13, 1996

Related U.S. Application Data

[63] Continuation-in-part of Ser. No. 423,644, Apr. 17, 1995, Pat. No. 5,593,510.

[30] Foreign Application Priority Data

Jan. 30, 1996 [JP] Japan ..... 8-014365

[51] Int. Cl.[6] ..... C21D 1/06; C23C 8/66

[52] U.S. Cl. ..... 148/206; 148/319

[58] Field of Search ..... 148/206, 225, 148/316, 319

[56] References Cited

U.S. PATENT DOCUMENTS

| | | |
|---|---|---|
| 3,765,929 | 10/1973 | Martin . |
| 3,827,923 | 8/1974 | Harvey et al. . |
| 5,252,145 | 10/1993 | Tahara et al. . |
| 5,340,412 | 8/1994 | Yoshino et al. . |
| 5,424,028 | 6/1995 | Maloney et al. . |

FOREIGN PATENT DOCUMENTS

| | | |
|---|---|---|
| 0 408 168 | 1/1991 | European Pat. Off. . |
| 59-13065 | 1/1984 | Japan . |
| 3-61345 | 3/1991 | Japan . |
| 5-163563 | 6/1993 | Japan . |
| 60-067651 | 8/1995 | Japan . |

*Primary Examiner*—Deborah Yee

*Attorney, Agent, or Firm*—Armstrong, Westerman, Hattori, McLeland & Naughton

[57] ABSTRACT

A method of carburizing austenitic stainless steel comprising the steps of holding austenitic stainless steel in a fluorine- or fluoride-containing gas atmosphere with heating prior to carburizing and carburizing the austenitic stainless steel at a temperature not more than 680° C. wherein said austenitic stainless steel is stable austenitic stainless steel having 1 to 6 weight % molybdenum or 13 to 25 weight % chromium, wherein a carburized hard layer having corrosion resistance superior to base material forms and austenitic stainless steel products obtained thereby.

4 Claims, 4 Drawing Sheets

METHOD OF CARBURIZING AUSTENITIC STAINLESS STEEL AND AUSTENITIC STAINLESS STEEL PRODUCTS OBTAINED THEREBY

FIELD OF THE INVENTION

This application is a continuation-in-part of application Ser. No. 08/423,644, filed Apr. 17, 1995, now U.S. Pat. No. 5,593,510, and relates to a method of carburizing austenitic stainless steel for hardening its surface and improving corrosion resistance, and austenitic stainless steel products obtained thereby.

BACKGROUND OF THE INVENTION

Austenitic stainless steel has been widely employed for its superior corrosion resistance property and its capability of decorativeness. Particularly, fasteners such as bolts, nuts, screws, washer and pins are made of austenitic stainless steel material in view of these properties. Besides, austenitic stainless steel products have been adopted for a variety of machine parts such as various shafts, impellers, molds, springs, chains and valves of machinery or equipment in fields of food machinery, chemical plants, nuclear power and the like where high corrosion resistance is required. However, strength itself for most of the above austenitic stainless steel products is improved in an intermediate processing step before a final step to make each shape thereof, which differs from general carbon steel material. For example, the crystal structure of the austenitic stainless steel is closely tightened by cold working or warm working represented by press working, extrusion molding, panting and the like, so-called work hardening, so as to strengthen the material itself. Such improvement of the strength in the intermediate processing step is necessarily limited because there are restrictions to shape the material into a specific shape such as a bolt or a nut and also to lower the cost of a mold in the extrusion molding and the like. Therefore, when surface rigidity or anti seizure is especially demanded for austenitic stainless steel products like fasteners such as a bolt, a nut and the screw, a pump shafts, bearings and springs, the following methods are available.

① Hard chromium plating or wet type metal plating such as Ni-P, ② coating such as physical vapor deposition, abbreviated to PVD hereinafter, or ③ hardening treatment by penetration such as nitriding or carburizing.

However, the above methods such as the wet type metal plating or the coating like PVD have drawbacks of shortening product lifetime due to peeling of a coat formed on the surface of the products. Thus, the application of hardening treatment by penetration such as carburizing is examined.

Further, nitriding, among the above hardening treatments by penetration, comprises penetrating nitrogen atoms into the surface of austenitic stainless steel material to the inside thereof so as to form a hard nitrided layer on the surface. However, in this method, the surface hardness of the products is improved, while a vital problem of deteriorating an essential property of anti-corrosion is caused on the other hand. Namely, it is thought that anti-corrosion property deteriorates because chromium atoms (which improve anti-corrosion property) contained in the austenitic stainless steel material itself are consumed as chromium nitrides such as CrN and $Cr_2N$ in the hard nitrided layer and their content therein is lowered. Still further, there are problems that the surface blisters, the surface roughness deteriorates, the products are magnetized, or the like.

As the other methods for the above hardening treatments by penetration, there is carburizing. A conventional carburizing method comprises contacting the surface of products with a gas containing carbon so as to invade the carbon atoms into the surface layer and form a hard carburized layer. In this method, carburizing is generally conducted at a temperature of not less than 700° C. of an $A_1$ transformation temperature of iron by considering the permeation speed of carbon atoms and a limit of solid solution. This means, however, that the austenitic stainless steel products have been maintained at a temperature far beyond the recrystallization of iron (N.B. a temperature of recrystallization of iron is about 450° C.) for a long time. As a result, the base material of the hardened austenitic stainless steel by work hardening softens by recrystallization and the like, resulting in a remarkable deterioration of the strength of the products, which is a great drawback. Moreover, there is another problem that corrosion resistance drastically deteriorates. This is because chromium carbide precipitates in the carburized layer of austenitic stainless steel when the austenitic stainless steel being carburized at such a high temperature, and chromium as solid solution of the austenitic stainless steel is consumed for forming the carbide and their content therein is lowered. Accordingly, it is a current situation that carburizing has never been conducted on austenitic stainless steel up to the present accordingly.

OBJECT OF THE INVENTION

Accordingly, it is an object of the invention to provide a method of carburizing austenitic stainless steel to improve the surface hardness drastically without deteriorating the strength originated from the base material, and moreover to form a hard surface layer having corrosion resistance superior to the base material, too, and to provide austenitic stainless steel products obtained thereby.

DISCLOSURE OF THE INVENTION

To accomplish the above object, the invention provides a method of carburizing austenitic stainless steel, with reference to claim 1, comprising maintaining the austenitic stainless steel under a fluorine- or fluoride-containing gas atmosphere with heating prior to carburizing and then carburizing the austenitic stainless steel by setting the temperature of the carburizing at not more than 680° C. wherein said austenitic stainless steel is stable austenitic stainless steel having 1 to 6 weight % molybdenum or 13 to 25 weight % chromium, wherein a carburized hard layer having corrosion resistance superior to base material forms.

Secondly, the invention provides, with reference to claim 2, a method of carburizing austenitic stainless steel according to claim 1, wherein the carburizing temperature is set within a range of 400° to 500° C.

Thirdly, the invention provides, with reference to claim 3, a method of carburizing austenitic stainless steel according to claim 1 or 2, wherein the temperature in a fluorine- or fluoride-containing gas atmosphere in the heating step is set within a range of 250° to 450° C.

Finally, the invention provides, with reference to claim 4, austenitic stainless steel products wherein base material is stable austenitic stainless steel including 1 to 6 weight % molybdenum or 13 to 25 weight % chromium, a surface layer in depth of 5 to 70 μm from the surface is hardened by invasion of carbon atoms so as to be formed into a carburized hard layer whose hardness is 500 to 1050 Hv of Micro Vickers hardness, wherein the carburized hard layer is formed by an austenitic phase in which chromium carbide particles do not exist and whose corrosion resistance is superior to the base material.

During a series of studies to improve the technology for better surface hardness of austenitic stainless steel, the concept was developed that carburizing austenitic stainless steel becomes possible at a temperature of not more than an $A_1$ transformation temperature of steel if pre-treatment with a fluorine- or fluoride-containing gas is conducted before carburizing. During a process based upon this concept it was found that carburizing becomes possible, which has been regarded as impossible heretofore, if the austenitic stainless steel is treated with a fluorine- or fluoride-containing gas prior to carburizing or at the same time as carburizing. Especially, it was also found that more effective carburizing can be realized at not more than 680° C., preferably not more than 500° C., instead of not less than 700° C. employed heretofore. As a result of further studies, it was found that adoption of stable stainless steel as the austenitic stainless steel makes it possible to maintain an austenitic single phase without precipitation of ferrite by the intermediate processing prior to carburizing, which realizes evenly high hardness in the carburized layer with no magnetism. Moreover, the present invention was reached by finding that the resultant carburized layer has a corrosion resistance superior to the base material by employing stable stainless steel containing 1 to 6 weight % molybdenum or that containing 13 to 25 weight % Cr, especially among the above stable stainless steel. Stable stainless steel means here stainless steel which completely shows an austenitic phase without ferrite in a view of metallic organization, even after being processed into a specific shape at a normal temperature.

At present, the reason why the carburized layer having corrosion resistance superior to the base material is not clear. As a possible reason, it is thought that a barrier band originated from a C-rich layer formed on the surface layer forms so as to prevent metal ions from dispersing. In this way, a surface layer is formed in 5 to 70 μm depth of the carburized layer, wherein the hardness of the carburized layer is in the range of 500 to 1,050 Hv of Micro Vickers Hardness. Moreover, the carburized layer comprising an austenite phase, which does not precipitate chromium carbide, shows corrosion resistance superior to the base material. In addition, there is no problem caused such as surface blisters, deterioration of surface roughness and the like, which have been the conventional problems in nitriding.

It is well known that the above-mentioned molybdenum is an element for stabilizing ferrite. For this reason, molybdenum is an obstruction factor against stabilization of an austenite phase of austenitic stainless steel. If a larger amount of molybdenum is added, the amount of stabilizing elements for austenite, such as Ni, N, or the like should be increased, resulting in a cost increase in raw materials or in manufacturing.

The less amount is better. Therefore, it is desirable that 1.0 to 2.5 weight % molybdenum is added to stable stainless steel as a standardized material as SUS316.

In the meantime, the austenite phase where chromium carbide grains do not exist means the austenite phase where crystalline carbides such as $Cr_{23}C_6$, $Cr_7C_3$, $Cr_3C_2$, or the like cannot be identified by an x-ray diffraction meter commonly used for analyzing the crystal structure of a metallic material. That is, the austenite phase (γ-phase), a base phase for austenitic stainless steel, has a face centered cubic lattice as its crystal structure wherein the lattice constant a=3.59 Å, resulting in a specific diffraction peak obtained by the x-ray diffraction. On the other hand, $Cr_{23}C_6$ is the same centered cubic lattice, however, with lattice constant a=10.6 Å, $Cr_7C_3$ is trigonal system with lattice constant a=14.0 Å and c=4.53 Å, and $Cr_3C_2$ is prismatic system with lattice constant a=5.53 Å, b=2.821 Å and c=11.49 Å. Therefore, these chromium carbides differ from the above austenite phase in crystal structure and lattice constant and cause different diffraction peaks from that of the austenite phase. If chromium carbide exists in a carburized hard layer, such peaks that cannot be seen in case of the austenite single phase may emerge. On the other hand, in the carburized hard layer of the present invention, chromium carbide does not exist and carbon atoms invade therein as solid solution so that the lattice of the base austenite phase distorts to form an isotropic austenitic phase, resulting in no emergence of peaks for chromium carbides by x-ray diffraction.

Besides, the stable stainless steel of the present invention means, as mentioned above, such stainless steel that does not produce ferrite metallographically at a normal temperature even after processing into a specific product shape and completely provides an austenite phase completely. In the FIG. 4 which shows the relationship between Cr equivalent and Ni equivalent (Schaeffler status), Cr equivalent and Ni equivalent of such stainless steel fall within a range (A). In addition, Cr equivalent and Ni equivalent mean values represented by the following formulae (1) and (2) respectively.

$$\text{Cr equivalent}=\text{Cr weight \%}+\text{Mo weight \%}+1.5\times\text{Si weight \%}+0.5\times\text{Nb weight \%} \quad (1)$$

$$\text{Ni equivalent}=\text{Ni weight \%}+30\times\text{C weight \%}+0.5\times\text{Mn weight \%} \quad (2)$$

In addition, in the present invention, evaluation of corrosion resistance is conducted by maintaining samples of carburized materials and untreated materials under the same accelerated corrosive environment and the same conditions and comparing the resultant significant difference indicating corrosion rate. Here, the accelerated corrosion environment means, for example, salt spray, immersion into physiological salt solution, immersion into acid solution such as HCl solution, however, these are not critical, either.

The present invention is now described in further detail.

In the present invention, carburizing after or at the same time as pretreatment by employing fluorine gas is conducted on stable austenitic stainless steel containing 1 to 6 weight % molybdenum or 13 to 25 weight % chromium.

As the stable austenitic stainless steel, there are SUS316, SUS316L and SUS317 which contain 1 to 3 weight % molybdenum, such stainless steel as contains 5 to 6 weight % molybdenum as well as 0.1 to 0.4 weight % N and 22 to 25 weight % Ni as austenite stabilizing elements, austenitic stainless steel material such as SUS304 and SUS310 which contain no molybdenum, 13 to 25 weight % Cr and 8 to 22 weight % Ni, and the like. In the present invention, these are mentioned as base materials.

The amount of the molybdenum to be added into the stable austenitic stainless steel is preferably 1 to 6 weight %, as mentioned above, more preferably 1 to 3 weight % from a viewpoint of cost.

Such stable austenitic stainless steel is employed often for fasteners such as bolts, nuts, screws, washers and pins. In the invention, austenitic stainless steel products include chains, a case for a watch, an edge of a spinning shuttle, a minute gear, a knife and machine parts for a wide variety of industries in addition to the above fasteners.

Prior to or at the same time as carburizing, fluorinating treatment is conducted on the above austenitic stainless steel under a fluorine- or fluoride-containing gas atmosphere.

A fluorine- or fluoride-containing gas is employed for this fluorinating treatment. As the above fluorine- or fluoride-containing gas, there are flourine compound comprising $NF_3$, $BF_3$, $CF_4$, HF, $SF_6$, $C_2F_6$, $WF_6$, $CHF_3$, $SiF_4$, $ClF_3$ and the like. These are employed solely or in combination. Besides, a fluorine- or fluoride-containing gas with F in its molecule can be used as the above-mentioned fluorine- or fluoride-containing gas. Also $F_2$ gas formed by cracking such flourine compound gas in a heat decomposition device and preliminarily formed $F_2$ gas are employed as the above-mentioned fluorine- or fluoride-containing gas. According to the situation, such flourine compound gas and $F_2$ gas are mixed for the use. The above-mentioned fluorine- or fluoride-containing gas such as the flourine compound gas and $F_2$ gas can be used independently, but generally are diluted by inert gas such as $N_2$ gas for the treatment. The concentration of fluorine-fluoride-containing gas itself in such diluted gas should amount to, for example, 10,000 to 100,000 ppm, preferably 20,000 to 70,000 ppm, more preferably 30,000 to 50,000 ppm by capacity. In the light of practicability, $NF_3$ is the best among the above compound gases. This is because $NF_3$ has chemical stability and is easy to treat since it is in a state a gas at an ordinary temperature. Such $NF_3$ gas is usually employed in combination with the above $N_2$ gas within the above concentration range.

In the invention, first of all, the above-mentioned non-nitrided austenitic stainless steel is held in a furnace under a heated condition in the fluorine- or fluoride-containing gas atmosphere within the above concentration range, and then fluorinated. In this case, the austenitic stainless steel is held with heating at the temperature of, for example, 250° to 600° C., preferably 280° to 450° C. The holding time of the above-mentioned austenitic stainless steel may be generally within the range of ten or so minutes or dozens of minutes. The passive coat layer, which contains $Cr_2O_3$, formed on the surface of the austenitic stainless steel, is converted to a fluorinated layer. Compared with the passive coat layer, this fluorinated layer is thought to be readily penetrated with carbon atoms employed for carburizing. That is, the austenitic stainless steel surface is formed to the suitable condition for penetration of carbon atoms by the above-mentioned fluorination.

Then, carburizing is conducted after the fluorination treatment like the above. In the carburizing, the above austenitic stainless steel itself is heated at not more than 680° C., preferably not more than 600° C., more preferably between 400° and 500° C. under a carburizing gas atmosphere, comprising CO and $H_2$, or comprising RX [RX components: 23% by volume CO (as abbreviated to vol % hereinafter), 1 vol % $CO_2$, 31 vol % $H_2$, 1 vol % $H_2O$, the remainder $N_2$] in a furnace.

Thus, the greatest characteristic in this invention is a low carburizing temperature in which the core part of the austenitic stainless steel may not be softened or solubilized.

In this case, the ratio of CO and $H_2$ is preferably 2 to 10 vol % for CO and 30 to 40 vol % for $H_2$.

BRIEF DESCRIPTION OF THE DRAWINGS

The above-mentioned fluorinating and carburizing steps are, for example, taken in a metallic muffle furnace as shown in FIG. 1, that is, the fluorinating treatment is carried out first at the inside of the muffle furnace, and then carburizing treatment is put in practice. In FIG. 1, the reference numeral 1 is a muffle furnace, 2 an outer shell of the muffle furnace, 3 a heater, 4 an inner vessel, 5 a gas inlet pipe, 6 an exhaust pipe, 7 a motor, 8 a fan, 11 a metallic container, 13 a vacuum pump, 14 a noxious substance eliminator, 15 and 16 cylinders, 17 flow meters, and 18 a valve. An austenitic stainless steel product 10 is put in the muffle furnace 1 and fluorinated with heating by introducing the fluorine- or fluoride-containing gas such as $NF_3$ from the cylinder 16, connected with a duct. The gas is led into the exhaust pipe 6 by the action of the vacuum pump 13 and detoxicated in the noxious substance eliminator 14 before being vented out. And then, the cylinder 15 is connected with the duct to carry out carburizing by introducing the carburizing gas into the muffle furnace 1. Finally, the gas is vented via the exhaust pipe 6 and the noxious substance eliminator 14. Through the series of these operations, fluorinating and carburizing treatments are put in practice.

By this treatment, "carbon" diffuses and penetrates on the surface of austenitic stainless steel so as to form a deep uniform layer. Such a layer realizes drastic improvement in hardness compared with the base material and also retains anti-corrosion property superior to that of the base material, because the layer is in a form wherein a base phase is greatly distorted due to solution of a great amount of carbon atoms.

For example, a SUS316 plate, a typical austenitic stainless steel, is carburized as follows. First the SUS316 plate was introduced into a muffle furnace 1 and was fluorinated at 350° C. for 20 minutes under a fluorine- or fluoride-containing gas atmosphere of $NF_3$ and $N_2$ ($NF_3$: 10 vol %, $N_2$: 90 vol %). After exhausting the above a fluorine- or fluoride-containing gas, a carburizing gas of Co, $CO_2$ and $H_2$ (38 vol % CO, 2 vol % $CO_2$ and 60 vol % $H_2$) was introduced into the furnace so that the SUS316 plate was kept at 450° C. in the furnace for 18 hours. As a result, a hard layer having a surface hardness of Hv of 850 (N.B. the core part is Hv of 220 to 230) and a thickness of 20 μm was formed. When this sample was put to the salt spray test (abbreviated to SST hereinafter) according to JIS2371, it did not rust at all over 480 hours. Further, the hard layer was not etched by Billrer reagent (acidic picric acid alcohol solution), which is employed for an anti-corrosion test of a stainless steel organization and was barely etched by aqua regia. Furthermore, the surface roughness hardly deteriorated, and dimension change by blistering and magnetism did not occur in the above sample.

As a result of further studies by varying the combination of various kinds of austenitic stainless steel plates, carburizing temperatures and the like, it was found out that the core of austenitic stainless steel easily softens and also anti-corrosion property of the hard layer drastically deteriorates when the carburizing temperature is over 600° C. Namely, it was found that from a viewpoint of anti-corrosion property, a carburizing temperature is preferably not more than 600° C., more preferably not more than 500° C., which brings about a better result. As mentioned above, a more preferable carburizing temperature is 400° to 500° C.

Figure 2A:
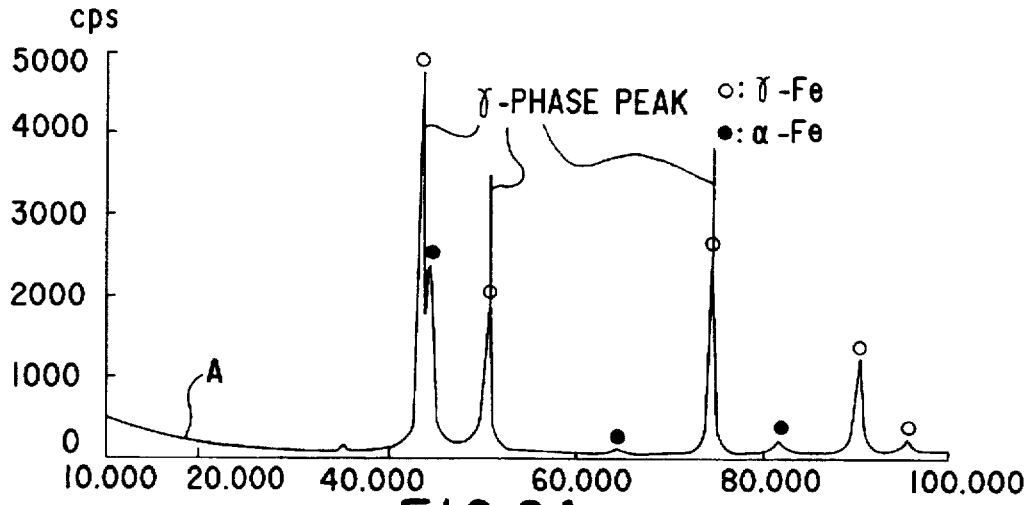
FIG. 2 shows curves of each x-ray diffraction on an untreated SUS 316 article, a carburized SUS 316 plate at 450° C. and an SUS316 plate, which was carburized at 480° C. and treat with strong acid.
Figure 2B:
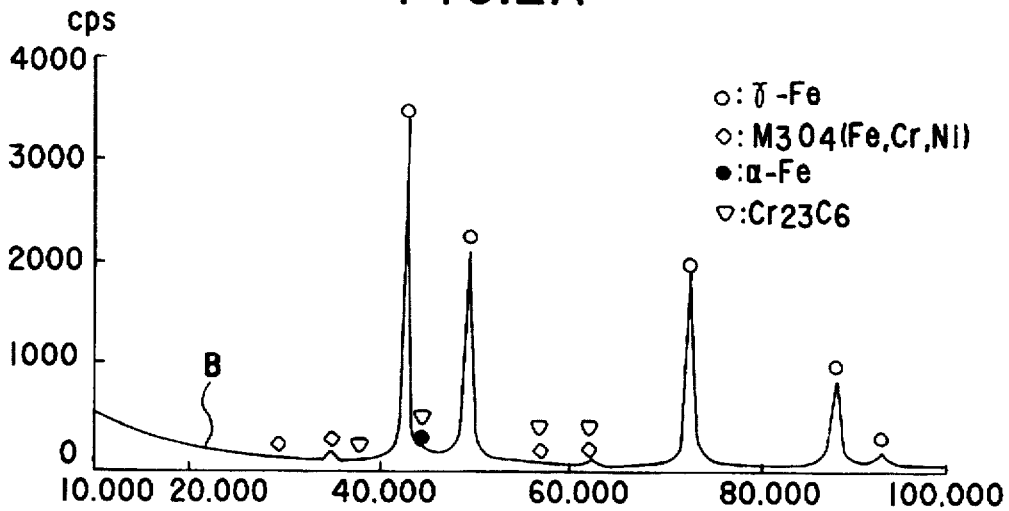
Figure 2C:
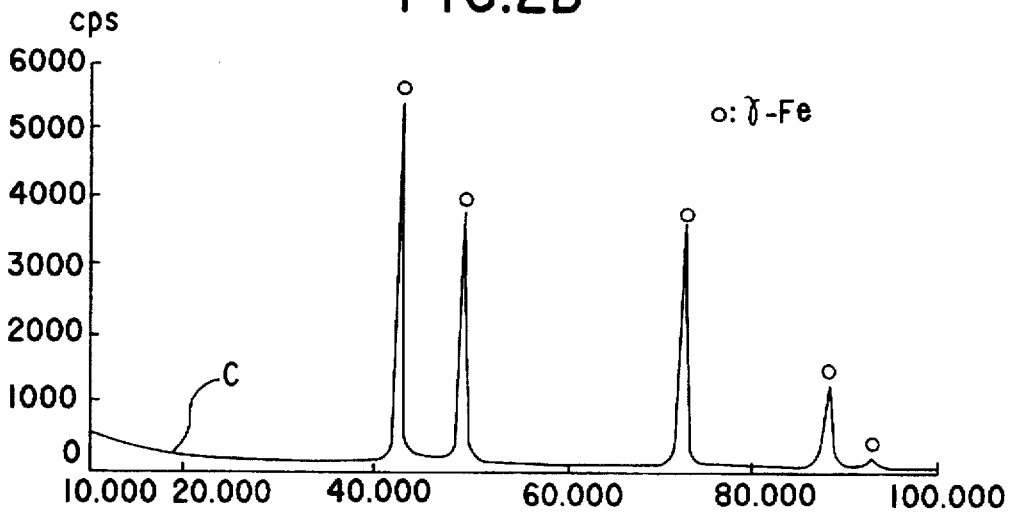

In the present invention, when a carburizing temperature increases, especially surpasses 450° C., a phenomenon occurs that carbide such as $Cr_{23}C_6$ precipitates on the surface of the hard layer, although it is a very small amount. However, even in this case, if a carburized article is soaked into strong acid such as HF-$HNO_3$ solution, HCl-$HNO_3$ solution or the like to remove the above precipitation, an anti-corrosion property higher than the base material and usually excellent surface hardness not less than Hv of 850 in Vickers hardness can be retained. Namely, in thus carburized austenitic stainless steel products, the carburized hard layer formed on the surface becomes black due to carburizing and the outermost layer may form into an iron inner oxide layer due to the presence of a small amount of oxygen atoms in the carburizing atmosphere, according to a situation. However, the removal of the inner oxide layer, as mentioned before, can be conducted by soaking into strong acid such as $HF-HNO_3$ solution and $HCl-HNO_3$ solution so as to remove the above deposit. Thereby, a corrosion resistance superior to that of the base material and high surface hardness not less than 850 Hv of Vickers hardness can be maintained. Austenitic stainless steel products wherein the inner oxide layer is removed by the above treatment show a glossiness the same as that before being carburized. A chart C of FIG. 2 shows an x-ray diffraction chart of an SUS316 article which is carburized at 480° C. and then soaked into strong acid of 5 vol % HF and 15 vol % $HNO_3$ concentration for 20 minutes, wherein no carbide was observed.

This is further described in detail. As a result of visual observation on the surface of products after being carburized, it was found out that a dark color layer exists in depth of 2 to 3 μm in the outermost layer. This layer was identified as an inner iron oxide layer by an x-ray diffraction method. This means that carburizing ($2CO \rightarrow CO_2+C$) and oxidation of Fe ($4CO_2+3Fe \rightarrow 4CO+Fe_3O_4$) may coexist at the same time under the atmosphere containing CO at a temperature between 400° and 500° C. so that the above inner oxide layer was formed. Such an inner iron oxide layer cannot be seen in conventional carburizing methods at not less than 700° C.

Further, in detail, when a socket bolt and a washer of SUS316L (C=0.02 wt %, Cr=17.5 wt %, Ni=12.0 wt % and Mo=2.0 wt %) were carburized at 480° C. for 12 hours, the hard layer depth was 30 μm and the surface hardness showed 910 Hv of Micro Vickers Hardness, however, the surface color was black. Consecutively, these black colored carburized articles were soaked into solution of 5 vol % HF–25 vol % $HNO_3$ heated to 50° C. for 20 minutes and then conducted with soft blast so that a socket bolt and a washer, which showed glossy appearance as the same as those before being carburized, could be obtained. These were subjected to JIS 2371 Salt Spray Test and no rust was caused in 2,000 hours. Further, corrosion resistance superior to the base material was confirmed in organic and inorganic acid resistance tests and an elusion test for physiological salt solution.

Figure 3:
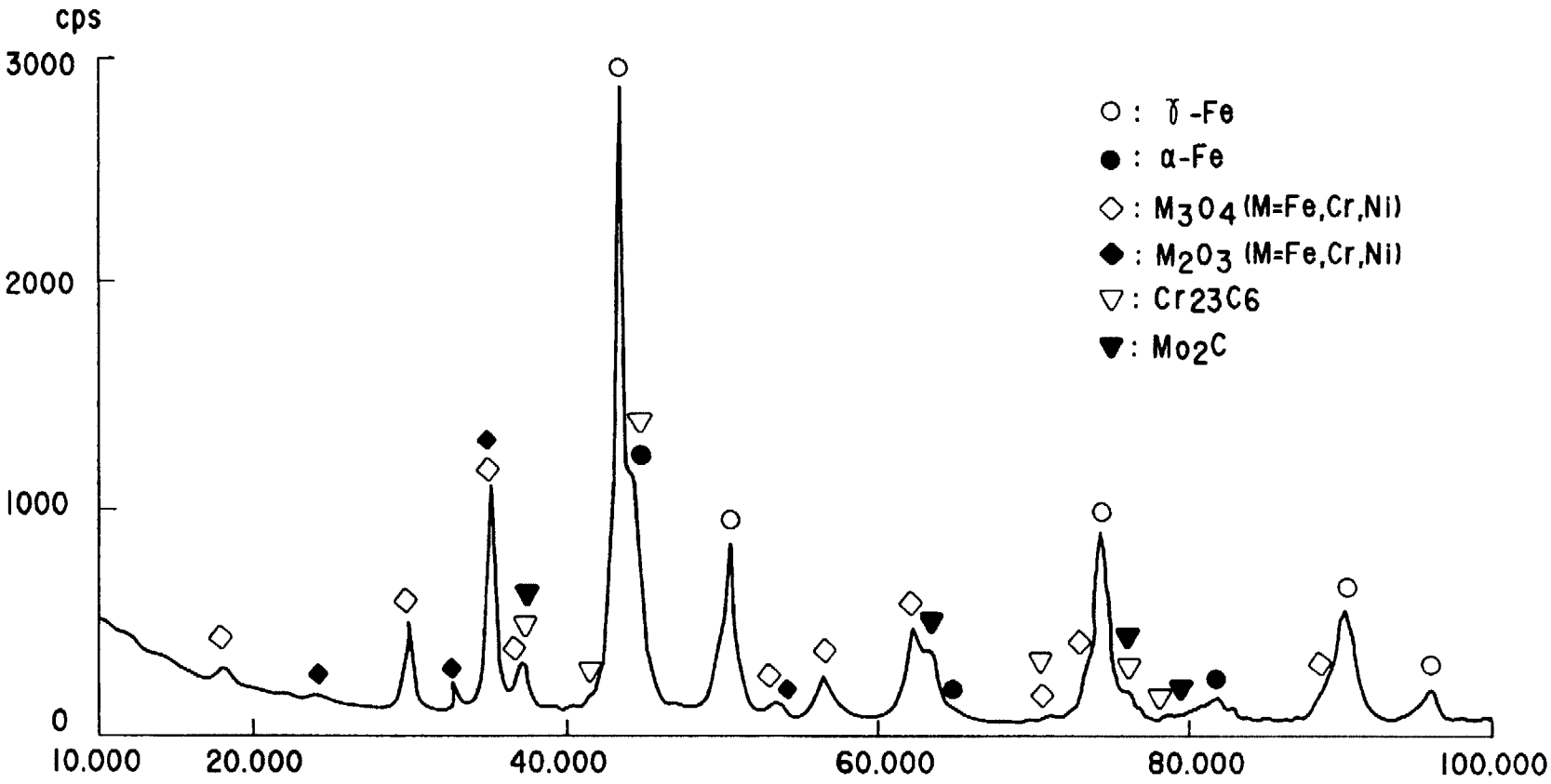
FIG. 3 shows a curve of x-ray diffraction on an SUS 316 plate which was carburized at 600° C.
Figure 4:
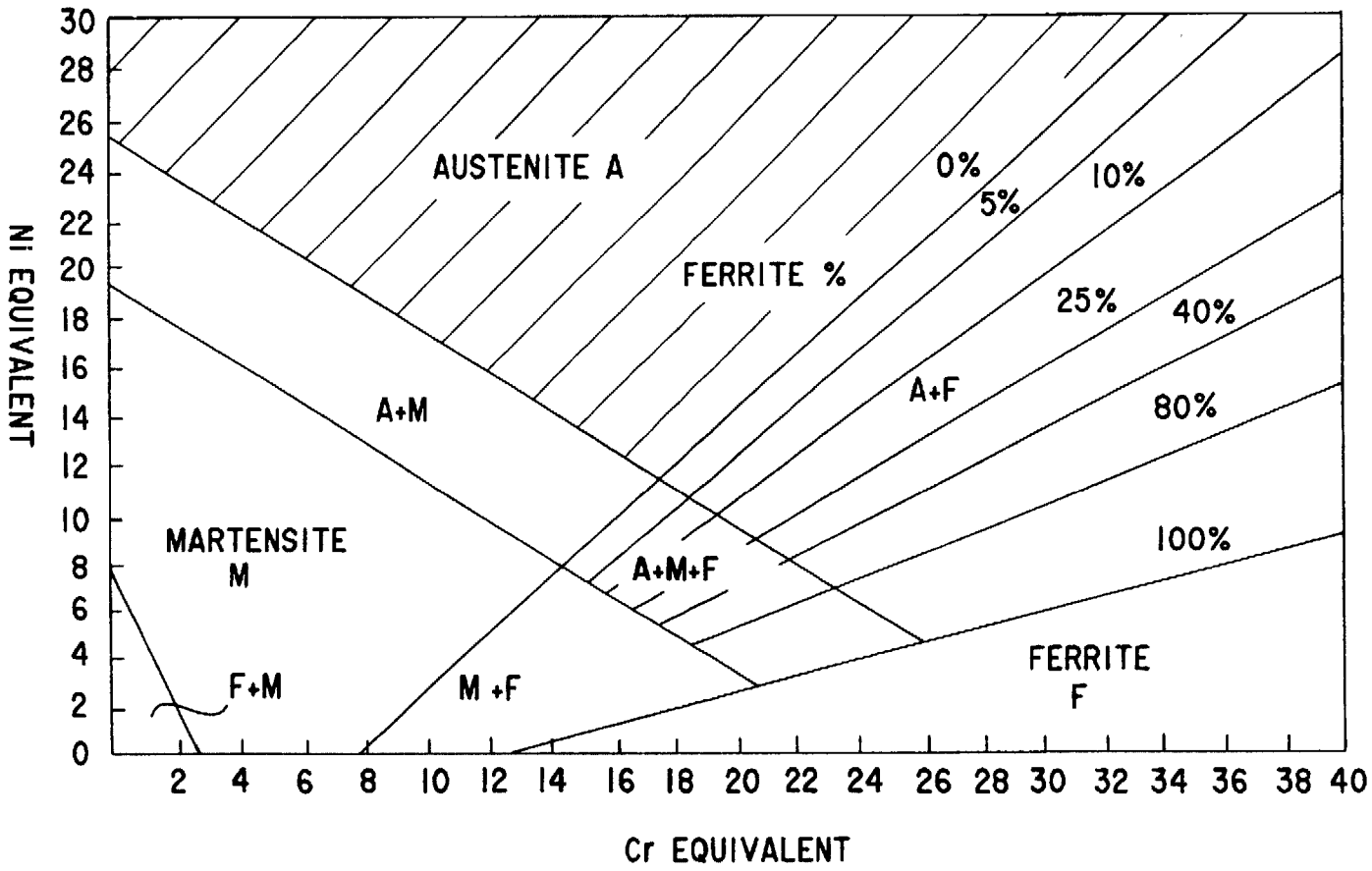
FIG. 4 shows the relationship between Cr equivalent and Ni equivalent.

Thus, according to the carburizing method of this invention, the articles with such a treatment retain excellent anti-corrosion property, which is thought to be due to the following two reasons. Since fluorinating treatment is conducted prior to carburizing, a low carburizing temperature not more than 680° C. can be realized. By this carburizing at a low temperature, chromium element, which is thought to work for improving anti-corrosion property in austenitic stainless steel, is difficult to precipitate and fix as carbide such as $Cr_7C_2$, $Cr_{23}C_6$ or the like and then the volume of fixed precipitation lowers, whereby much chromium element remains in the austenitic stainless steel. In this way, deterioration in corrosion resistance of the base material can be prevented. This is clear by comparing an x-ray diffraction results for an SUS316 article (an x-ray diffraction chart shown in FIG. 3), which was fluorinated under a fluorine- or fluoride-containing gas of 10 vol % $NF_3$ and 90 vol % $N_2$ at 300° C. for 40 minutes and then carburized under a carburizing gas of 32 vol % CO, 3 vol % $CO_2$ and 65 vol % $H_2$ at 600° C. for 4 hours, and for an SUS316 article (an x-ray diffraction chart B shown in FIG. 2), which was fluorinated in the same way and carburized at 450° C. for 16 hours, with an x-ray diffraction result for an SUS316 article (an x-ray diffraction chart A shown in FIG. 2), which was untreated. That is, a peak of $Cr_{23}C_6$ is sharp and high in articles carburized at 600° C. in FIG. 3. This means that the above chromium carbide precipitates relatively significantly while less chromium element remains in austenitic stainless steel. On the other hand, a peak of $Cr_{23}C_6$ can be hardly identified in carburizing at 450° C. in FIG. 2 (B). This means that the precipitation of the above chromium carbide is extremely low while more chromium element remains in austenitic stainless steel, resulting in a high anti-corrosion property. Secondly, by employing stable stainless steel containing 1 to 6 weight % molybdenum or 13 to 25 weight % chromium, a barrier band originated from a C-rich layer formed on the surface layer forms so as to prevent metallic ions from dispersing and also molybdenum may contribute to improvement in acid resistance of the austenitic stainless steel, resulting in corrosion resistance of the carburized layer superior to the base material.

Furthermore, an improvement in hardness of the carburized articles is thought to be attributed to occurrence of austenite lattice distortion by penetration of carbon atoms. It is clear that austenite lattice distortion is caused in a carburized article in FIG. 2 (B) and (C), because austenite phase peak position (B shown in FIG. 2) of a carburized article at 450° C. and that (C shown in FIG. 2) of a carburized and acid-treated article at 480° C. according to an x-ray diffraction shift to low angle side (left side) from that (A shown in FIG. 2) of untreated SUS316 article. In addition, the above x-ray diffraction was conducted by RINT1500 device at 50 KV, 200 mA and Cu target.

In addition, since the diffusion speed of C in austenitic organization is relatively slow in case of a low temperature region not more than 500° C., it takes a considerable time to obtain a thick layer. For example, the above carburized hard layer on SUS316L series, in which a hard layer becomes the thickest, becomes 37 μm with treatment at 490° C. for 12 hours and becomes only 49 μm with additional treatment for another 12 hours. To obtain a hard layer in 70 μm depth, it takes not less than 70 hours. Such long-time treatment is not economical. Even in drill tapping, which requires a hard layer to be as thick as possible, it is possible to drill SPCC (Steel Plate Cold Coiled) of 2.3t with a hard layer in 40 μm depth, whereby a useful hard layer can be obtained in suitable time with economical efficiency. In addition, when carbon concentration in the above carburized layer is set at or around 2.0 weight % as an upper limit, the effect of improving surface hardness can be increased.

EFFECT OF THE INVENTION

As mentioned hereinbefore, carburizing austenitic stainless steel according to the invention utilizes a low carburizing temperature of not more than 680° C. because the austenitic stainless steel is kept being heated under the fluorine- or fluoride-containing gas atmosphere prior to or at the same time as carburizing. Therefore, a high surface hardness as well as an anti-corrosion property superior to the base material can be realized without deteriorating high processability inherent in austenitic stainless steel itself. In addition, since the surface hardness is improved thanks to the above carburizing, any inconveniences such as surface roughness caused by nitriding, dimension inaccuracy by blistering and magnetization in austenitic stainless steel itself do not occurred at all.

Thus obtained austenitic stainless steel products have a hard layer in depth of 5 to 70 μm which is formed into a carburized layer by invasion of carbon atoms of 500 to 1,180 Hv Micro Vickers Hardness, preferably 500 to 1,050 Hv. Further, since chromium carbide is not deposited in the carburized hard layer and formed by an austenitic phase, the obtained products show corrosion resistance superior to the base material due to formation of C-rich band of the outermost layer. Therefore, thus obtained products are useful for fasteners such as bolts, nuts and screws as well as a variety of machine parts for general industrial fields such as various shafts, impellers, bearings, springs, and valve parts. In addition, especially, these are promising as materials for machine parts employed in fields of food machinery, chemical plants and semiconductor industry.

The following example is further illustrative of the invention.

EXAMPLE 1

Figure 1:
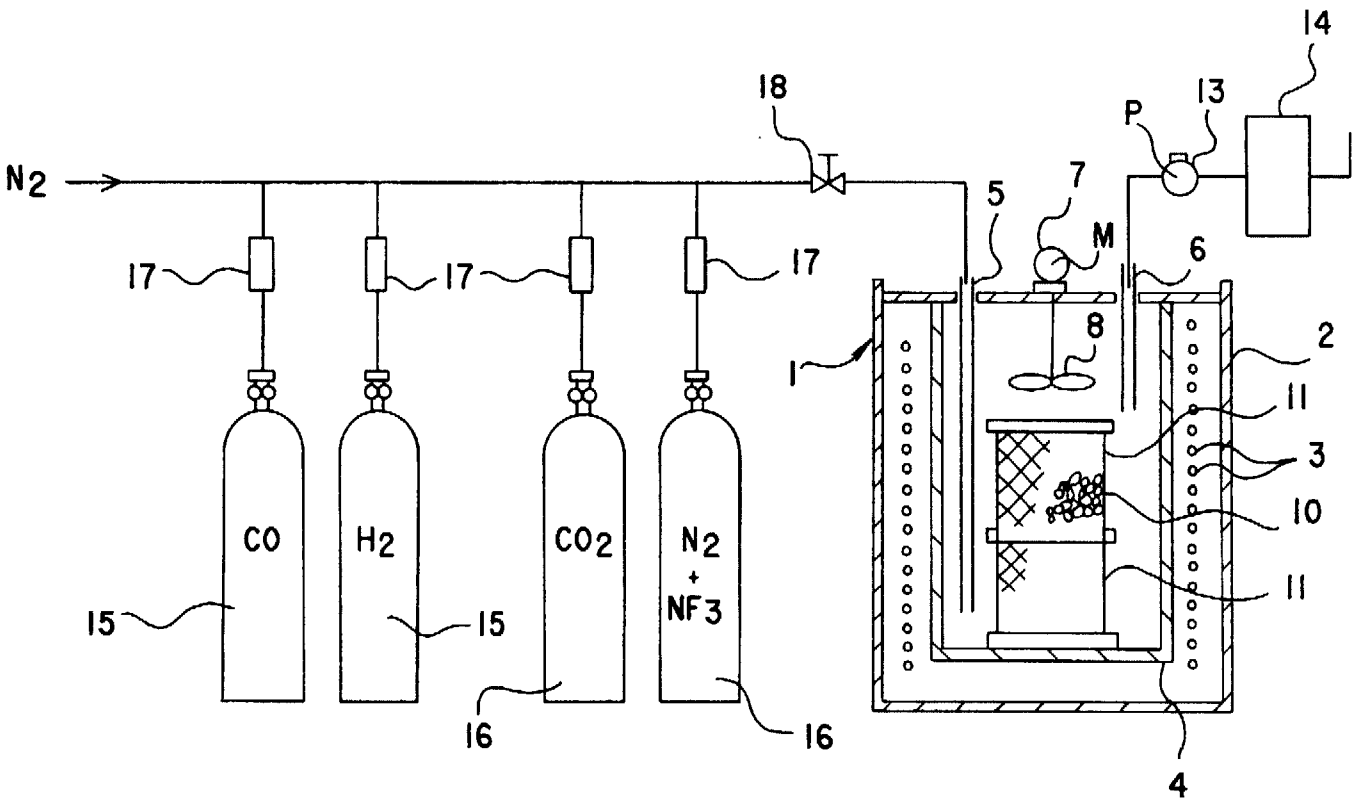
FIG. 1 schematically shows a construction of a furnace for carrying out carburizing according to the invention.

Plural rolled plates (2.5t×15×15) of SUS316 (Cr content: 17 weight %, Ni content: 13.5 weight %, Mo content: 2.5 weight %, C content: 0.07 weight % and Fe content: the remainder) and plural rolled plates (2.5t×15×15) of SUS304 (Cr content: 18.5 weigh %, Ni content: 8.5 weight %, C content: 0.08 weight % and Fe content: the remainder) were prepared as examples. The core hardness of these materials were Hv=220 to 230 for SUS316 materials and Hv=170 to 180 for SUS304 materials. These materials were fluorinated by blowing a gas mixture of 20 vol % $NF_3$ and $N_2$ for the remainder into a furnace shown in FIG. 1 for 15 minutes when being heated to 320° C. therein, purged with $N_2$ gas and heated to 480° C. Subsequently, a carburizing gas of 31 vol % $H_2$, 21 vol % CO, 1 vol % $CO_2$ and the remainder of $N_2$ was charged therein. The materials were maintained therein for 15 hours so as to be carburized. Consecutively, such treated materials were dipped into solution of 3 vol % HF and 15 vol % $HNO_3$, heated to 55° C., for 30 minutes to be cleansed.

As a result of measuring depth and hardness of these hard layers, the depth and hardness for SUS316 were 32 μm and Hv=980, while those for 304 were 28 μm and Hv=1,080 respectively.

As samples, plates of the above carburized SUS316 materials, SUS304 materials and also both untreated materials were dipped into solution of 5 vol % HCl, heated to 50° C. and maintained for 3 hours. Subsequently, each elusion concentration of metallic ions was determined by atomic absorption analysis for evaluation of corrosion resistance. The results are shown in the following table 1.

TABLE 1

| | TIME | TEMPERATURE | ELUSION CONCENTRATION OF METALLIC IONS (ppm) | | |
|---|---|---|---|---|---|
| | (H) | (°C.) | Fe | Ni | Cr |
| SUS316 | | | | | |
| Untreated | 3 | 50 | 198 | 30 | 40 |
| Carburized | 3 | 50 | 3.6 | 0.6 | 0.4 |
| SUS304 | | | | | |
| Untreated | 3 | 50 | 720 | 150 | 180 |
| Carburized | 3 | 50 | 150 | 33 | 28 |

As clear from the above results, the carburized SUS316 sample showed corrosion resistance drastically superior to the untreated sample (i.e., the base material). Besides, the carburized 304 sample showed corrosion resistance superior to the untreated sample.

What is claimed is:

1. A method of carburizing austenitic stainless steel comprising the steps of holding austenitic stainless steel in a fluorine- or fluoride-containing gas atmosphere with heating prior to carburizing and carburizing the austenitic stainless steel at a temperature not more than 680° C. wherein said austenitic stainless steel is stable austenitic stainless steel having 1 to 6 weight % molybdenum or 13 to 25 weight % chromium, wherein a carburized hard layer having corrosion resistance superior to base material forms.

2. A method of carburizing austenitic stainless steel according to claim 1, wherein the carburizing temperature is set within a range of 400° to 500° C.

3. A method of carburizing austenitic stainless steel according to claim 1 or 2, wherein the temperature in fluorine- or fluoride-containing gas atmosphere in the heating step is set within a range of 250° to 450° C.

4. Austenitic stainless steel products wherein base material is stable austenitic stainless steel including 1 to 6 weight % molybdenum or 13 to 25 weight % chromium, a surface layer in depth of 5 to 70 μm from the surface is hardened by invasion of carbon atoms so as to be formed into a carburized hard layer whose hardness is 500 to 1050 Hv of Micro Vickers hardness, wherein the carburized hard layer is formed by an austenitic phase in which chromium carbide particles do not exist and whose corrosion resistance is superior to the base material.

* * * * *